United States Patent [19]

Dubach

[11] Patent Number: 4,802,597

[45] Date of Patent: Feb. 7, 1989

[54] PLASTIC STOPPER FOR A CONTAINER, WITH A MEASURING CUP THAT SERVES AS A CAP

[75] Inventor: Werner F. Dubach, Maur, Switzerland

[73] Assignee: Alfatechnic AG, Dielikon, Switzerland

[21] Appl. No.: 142,864

[22] Filed: Jan. 11, 1988

[30] Foreign Application Priority Data

Jan. 22, 1987 [CH] Switzerland ..... 223/87

[51] Int. Cl.[4] ..... B65D 51/24

[52] U.S. Cl. ..... 215/307; 141/381; 222/111; 222/546

[58] Field of Search ..... 215/307, 228, 309; 222/111, 546; 141/381

[56] References Cited

U.S. PATENT DOCUMENTS 4,171,749 10/1979 Obrist et al. ..... 215/307 X
4,616,759 10/1986 Mahler ..... 141/381 X

FOREIGN PATENT DOCUMENTS 1140707 3/1957 France ..... 215/307
1145945 10/1957 France ..... 215/307
922188 3/1963 United Kingdom ..... 222/546

*Primary Examiner*—Donald F. Norton
*Attorney, Agent, or Firm*—Lee & Smith

[57] ABSTRACT

The two-sided plastic stopper has a lower portion (1) that can be secured to the neck of a container (14, 15) and a measuring cup (2) which can be reversed and set on the lower portion so as to form a seal, this serving as a cap. A tubular spout (11) is surrounded by a concentric annular wall (12). In this way a trough (18) is formed together with the connecting wall (13) between the spout (11) and the annular wall (12), this trough having a drain (19) that leads back to the container. Within the base of the measuring cup (21) there is a centrally arranged annular wall (23) in the form of a sealing plug. This sealing plug (23) and the tubular spout (11) fit together in a form fit so as to seal each other and have connecting means that act together, preferably threads (17, 24, respectively).

11 Claims, 4 Drawing Sheets

PLASTIC STOPPER FOR A CONTAINER, WITH A MEASURING CUP THAT SERVES AS A CAP

Figure 1:
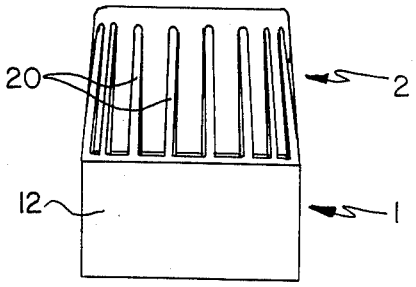

The present invention relates to a plastic stopper for a container used for free-flowing medium, this incorporating a measuring cup that also serves as a cap.

Stoppers of the above type are known, for example, from FR-A-1.448.275 published June 27, 1966 and from EU-A 0 109 704 published May 30, 1984. These known stoppers have a lower section that can be secured on the container and incorporate a tubular spout that is directed outwards and a wall that surrounds this, said wall forming an annular trough about the tubular spout. The annular trough has a drain that serves to return residual quantities of the medium that are located in it back to the container. The measuring cup, which also serves as a cap, lies in the closed state with its rim within the annular trough. Thus, residual quantities flow from the measuring cup into the annular trough and from there back into the container The measuring cup is connected to the lower portion by means of attachment devices that are installed on the outer edge of the measuring cup and on the inner side of the wall that surrounds the pouring spout. Normally, the connecting devices that are provided are in the forms of interacting threads.

The basic concept of such stoppers is to avoid soiling the outside of the stopper. The generation of stoppers that incorporate a return represent an important improvement over those stoppers in which the measuring cup is simply slipped over the lower portion on the container. Nevertheless, contrary to what was expected, there is still some soiling of the stopper after repeated use. This soiling is the result of two interacting effects. The measured quantity that has been poured into the measuring cup has a tendency to adhere to the edge of the cup when emptied and depending on the surface tension of the free-flowing medium in question will creep to a more or less marked extent to the outer wall of the measuring cup. Thus, residual quantities of the liquid get into the area of the thread. Each time the stopper is closed a new and relatively small quantity of the medium is pushed up into the thread and then gets outside the thread into the outer part of the stopper. The applicant has recognized these effects and has thus undertaken the task of creating a stopper in which this undesirable effect is avoided.

This task has been solved by a plastic stopper according to the defining portion of claim 1, characterized in that the measuring cup (2) that serves as a cap has an annular wall (23) that is arranged centrally in the bottom area (21) of the measuring cup and fits onto the tubular spout (11) so as to seal it, securing devices (24) being arranged on this annular wall (23), these working in conjunction with securing devices (17) that are arranged on the tubular spout (11).

Moving the connecting devices from the outer edge of the measuring cup into its interior and from the edge area of the lower portion into the area of the spout prevents a combination of the above-described effects.

Figure 2:
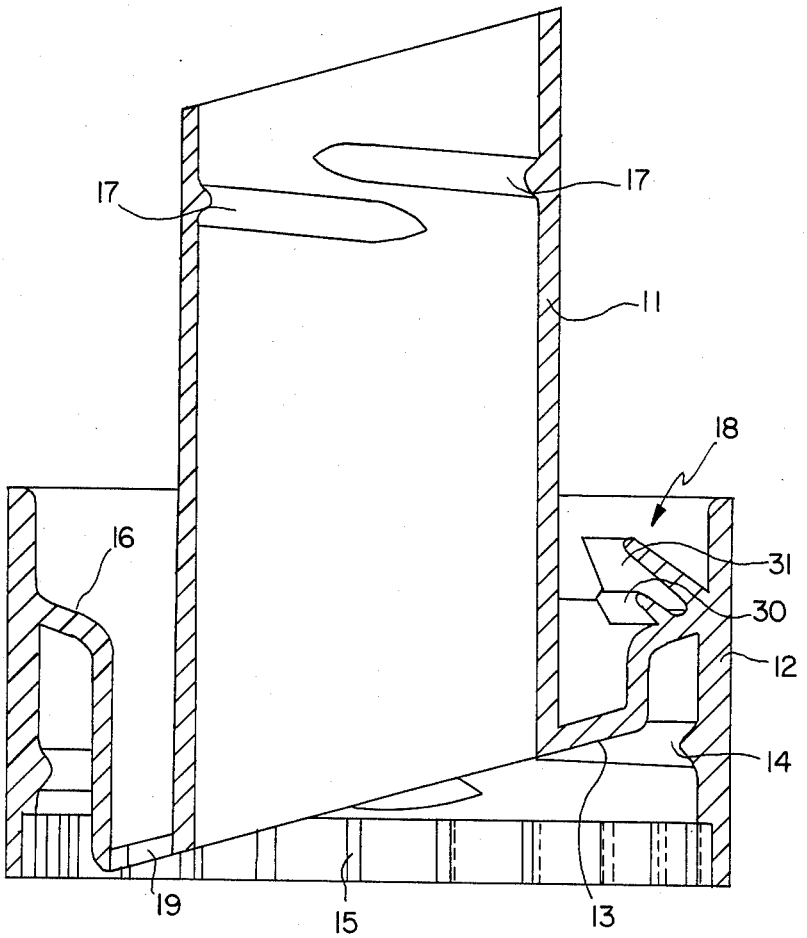
Figure 3:
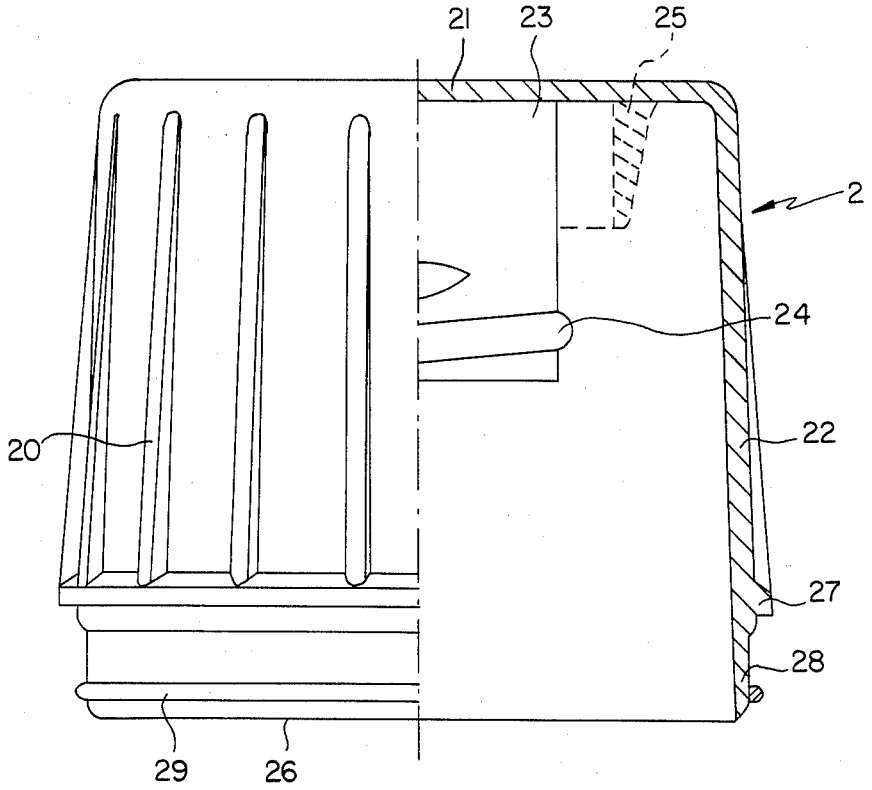
Figure 5:
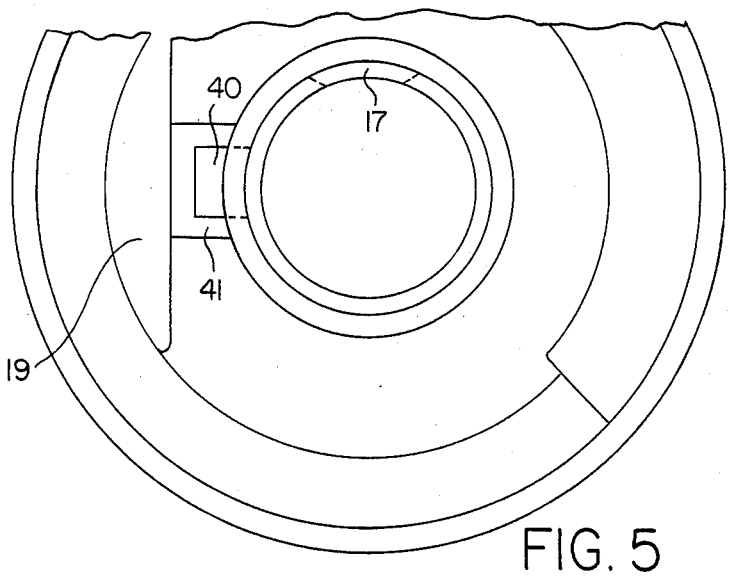
Figure 4:
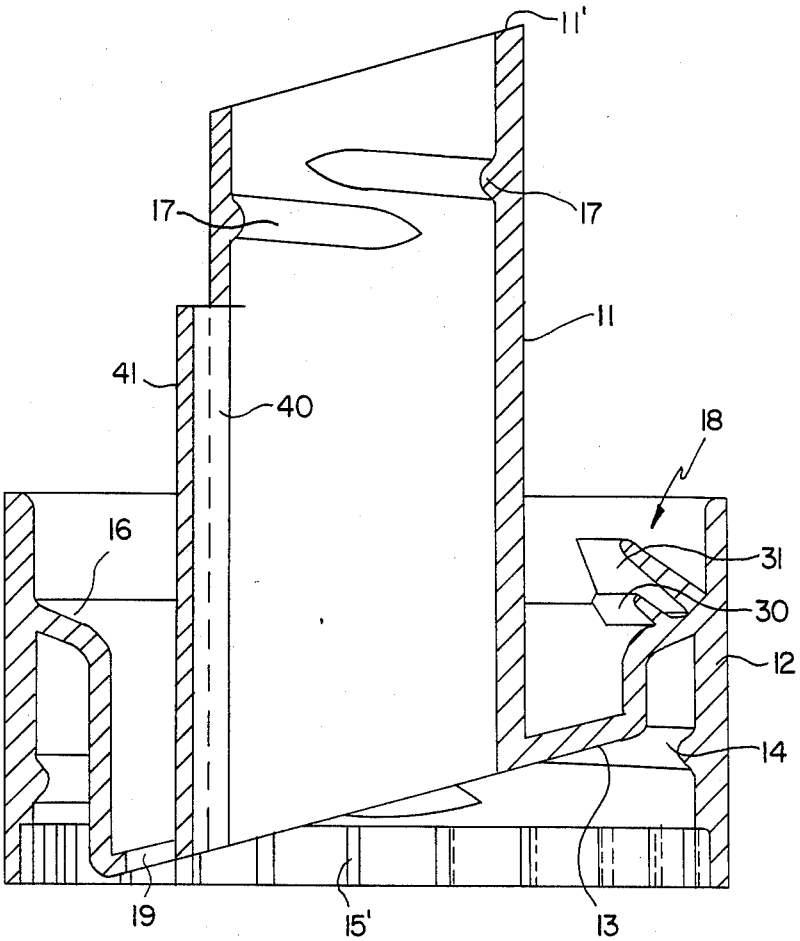

Further advantages and embodiments are set out in the sub-claims and are explained in greater detail below on the basis of the drawings appended hereto. These drawings show the following:

FIG. 1: the stopper according to the present invention, when closed, in side view;

FIG. 2: the lower portion of the two part stopper, this being shown at a greater scale, and in section;

FIG. 3: the measuring cup that fits on the lower portion, this serving as a cap, and being shown in partial cross section;

FIG. 4: a variation of the lower portion of the plastic stopper in longitudinal section;

FIG. 5: a variation as in FIG. 4, viewed from above.

Figure 6:
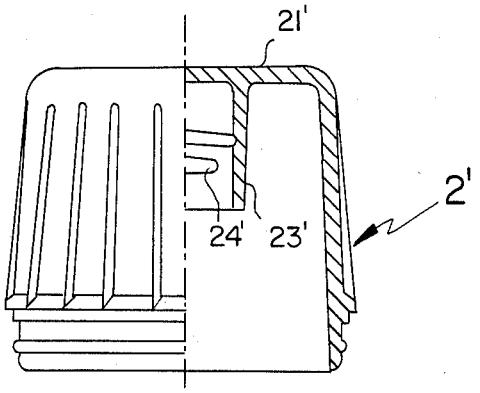
Figure 7:
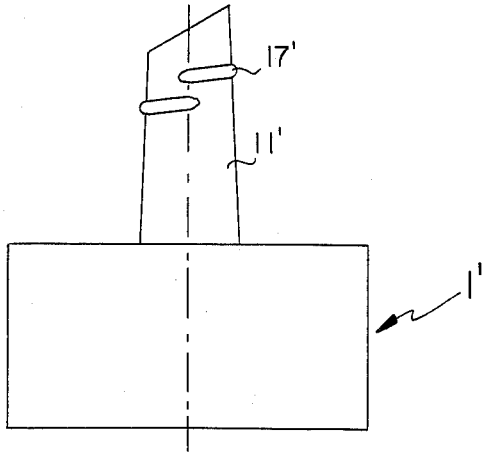

FIG. 6: a variation of the measuring cup shown in partial view cross section;

FIG. 7: a variation of the lower portion of the plastic stopper in side view.

The side view in FIG. 1 shows the lower portion 1 as a tubular casing and the conical measuring cup 2 that is set, reversed, on this, said measuring cup 2 serving as a cover for the stopper. The ribs 20, which can be plainly seen, make the measuring cup easier to grip. The edge of the measuring cup 2 which is uppermost when in the working position lies within the lower portion 1 when the stopper is closed.

FIG. 2 shows the lower portion 1 in greater detail and at a larger scale. Essentially, the lower portion 1 consists of a tubular spout 11 that is surrounded by an annular wall 12. The annular wall 12 and the tubular spout 11 are joined to each other by means of an intermediate wall 13 that is inclined to the longitudinal axis. The inner side of the annular wall 12 has an inside thread 14 and this fits on the outside thread on the neck of a container (not shown herein). The lowermost area of the inner side of the ring wall is provided with sawtooth serations 15 that match similar serations on the lower edge of the container neck and prevent the lower portion 1 being unscrewed from the container neck.

Peripherally, the intermediate wall 13 is raised to the point that sufficient room remains to accommodate the container neck. At its upper end, this forms an annular shoulder 16 that is inclined centrally to the discharge opening. The tubular spout 11 that extends considerably beyond the annular wall 12 is provided with an inside thread 17. Without departing from the concept of the invention, and whilst retaining the desired advantages thereof, the thread 17 can also be provided on the outside of the tubular spout 11.

Any residual quantities of the liquid medium that run down the outer wall of the tubular spout flow into the annular trough 18 that is formed by the annular wall 12 and the intermediate wall 13 passing around the tubular spout 11. In order to return these residual quantities from the trough 18 into the container (not shown herein) the intermediate wall 13 that is inclined towards the longitudinal axis is provided at least at its lowest point with a drain 19. If the container that is fitted with the stopper according to the present invention is lying down, liquid will flow from the container into the stopper and into the measuring cup through the drain 19. If one then places the container in a vertical position and unscrews the measuring cap 2 the major portion of this fluid will then flow back into the container. However, if liquid is then poured out, a relatively large quantity of liquid can flow into the trough 18 and over the edge of the annular wall 12. In order to prevent this happening, there is a smaller retaining lip 30 that extends around a part of the periphery of the inclined shoulder, and a further larger retaining lip 31 that is situated above this. Two retaining lips 30 and 31 together form a type of cascade-type dam.

The detailed configuration of the measuring cup that serves as a cover can be seen in FIG. 3. This measuring cup 2 has a flat bottom 21 and a side wall 22 that tapers conically down towards the bottom of the measuring cup. A tubular annular wall 23 is formed at the centre of the bottom of the measuring cup. The sealing plug that is formed by the annular wall 23 has an outside diameter that matches the inside diameter of the tubular spout 11. The sealing plug, or the annular wall 23, is provided with an outside thread 24 which, when the stopper is closed, works in conjunction with the inside thread in the tubular spout In order to increase the effectiveness of this seal a sealing lip 25 can be provided; this is shown in cross section by the dashed line in the drawing.

If the diameter of the tubular spout is small, it is also possible to provide the thread on the outside of the spout, as has been described heretofore, which will also mean that the thread on the annular wall 23 in the bottom of the measuring cup 21 will have to be provided on the inside of the annular wall.

Opposite the edge 26 of the measuring cup, and set back slightly therefrom, there is on the outside wall 22 of the measuring cup a shoulder 27. The shoulder 27 lies flush on the annular wall 12 of the lower portion 1 when the stopper is closed, and thus forms a compression seal between the lower portion 1 and the measuring cup 2. From the shoulder 27 to the edge of the measuring cup 26 the wall 22 of the measuring cup is formed into a sharp edged tapering annular lip 28. On the one hand, the sharp edge of this lip 28 improves the pouring characteristics of the measuring cup 2, and on the other hand, forms an additional seal between the cap 2 and the lower portion 1 in that, when the stopper is closed, it lies on the shoulder 16 that is inclined conically towards the trough 18.

Opposite the lip 28 and slightly above this there is an annular bead 29. When the measuring cap 2 is screwed into position this moves any residual quantities adhering to the annular wall 12 into the trough 18. The intermediate space between the shoulder 27 and the annular bead 29 forms an expansion space that prevents any remaining small quantities of liquid from being squeezed out and thus soiling the stopper.

The sealing plug, which is formed by the annular wall 23 in the base 21 of the measuring cup, can also serve as a second measuring cup to measure smaller quantities of liquid. This is a considerable advantage, if one remembers that in former solutions, measurement units which were in the form of barely visible symbols, were engraved on the inside wall of the measuring cup.

In those cases when containers are moved when horizontal the space between the annular wall 23 and the outside wall 22 of the cup, as well as the trough 18, can be filled completely. If one then places the container in a vertical position and opens the stopper, a considerable residual quantity of the container contents may be held in the measuring cup 2. The reason for this is that the tubular spout 11 is sealed tight and the relatively small drain 19 is also closed by the residual quantity of the container contents, thereby preventing the flow of air between the hollow space within the stopper and the container itself.

The embodiments shown in FIGS. 4 and 5 present a solution for this problem. The tubular spout 11 is provided with an elongated break 40. On the one hand, this break 40 is an enlarged return opening, and on the other serves as an air vent between the space beneath the cap 2 of the stopper and the container beneath the lower portion 1 of the stopper. However, in order that this opening 40 does not lead to the fact that the contents can flow from the container into the stopper even at a relatively slight angle of inclination, the opening 40 is surrounded by a wall 41. This wall 41 forms a tubular passage through which air can move Tests have shown that even under unfavourable conditions liquid can flow down the container neck within the time normally taken to screw the cap back onto the container.

Of course, the elongated opening 40, which runs parallel to the longitudinal axis of the cap, is to be installed on that side of the tubular spout where the drain 19 is also located, which is to say, in that section of the wall of the spout that is remote from the lips 30, 31. The tubular spout 11, which is cut off at an angle, thus forms a pouring lip 11', that defines a specific direction for pouring.

I claim:

1. A plastic stopper for a container used for free-flowing media, having a lower portion (1) that can be secured to a container and having a tubular protruding pouring spout (11), a wall (12) surrounding said spout and an intermediate wall (13) therebetween, said wall (12) and intermediate wall (13) forming an annular trough (18) about the pouring spout (11), said trough having a drain (19) for returning the medium to the container, as well as a measuring cup (2) that serves as a cap, said measuring cup having an annular inner wall (23) that fits said pouring spout, said inner wall and said spout being provided with coacting attachment means (17,24) the intermediate wall (13) of said annular trough being raised around its periphery to form an annular shoulder (16) that is inclined towards said spout (11), the lower end of the outer wall (22) of said measuring cup being formed as a sharp edged tapered lip (28), said tapered lip capable of lying on said raised inclined shoulder, when said measuring cup is held on said spout by said attachment means, for forming a sealed closure between said measuring cup and said lower portion.

2. A plastic stopper as defined in claim 1, wherein the measuring cup has a base (21) and wherein the annular wall 23 is arranged in the base (21) of the measuring cup and encloses the tubular spout and wherein said attachment means (17) are provided on an inner surface thereof and work in conjuction with said attachment means of said tubular spout that are provided on an outer surface of the tubular spout.

3. A plastic stopper as defined in claim 2, wherein the annular wall in the base of the measuring cup is configured as a second measuring cup to be used for smaller measured quantities.

4. A plastic stopper as defined in claim 1, wherein the annular wall (23) in the base (21) of the measuring cup protrudes into the tubular spout and has said attachment means (24) on an outer wall thereof, and being coactive with said attachment means (17) that are provided on an inner surface of the tubular spout.

5. A plastic stopper as defined in claim 1, wherein the intermediate wall (13) forms the base of the annular trough (18) and is inclined down an angle to the longitudinal axis of the stopper, and wherein the drain (19) is arranged in the deepest part of the trough.

6. A plastic stopper as defined in claim 5, wherein in the area above the highest point of the intermediate wall (13) that forms the base of the annular trough (18) on the wall (12) that surrounds the trough there is a retaining lip (31) that is oriented upwards towards the spout (11), said lip extending over at least a part of the periphery of the wall (12).

7. A plastic stopper as defined in claim 6, wherein beneath the retaining lip (31) on the shoulder (16) there is a second smaller retaining lip (30) that extends at least approximately perpendicular to the surface of the inclined shoulder, inwards towards the spout (11).

8. A plastic stopper as defined in claim 5, wherein the tubular spout (11) on the side that is proximate to the drain (19) there is an opening 40 that extends parallel to the longitudinal axis of the stopper.

9. A plastic stopper as defined in claim 8, wherein the tubular spout (11) has an inside thread (17) and wherein the opening (40) extends from the area of the bottom of the trough (18) to beneath the thread (17), the opening (40) being surrounded by a wall (41) that curves outwards from the centre to form a passage.

10. A plastic stopper as defined in claim 1 wherein the outside diameter of the lip (28) of the measuring cup (2) is smaller than the inside diameter of the annular wall (12) of the lower portion (1).

11. A plastic stopper as defined in claim 1, wherein outside on the lip (28) there is a peripheral annular bead (29) that provides a seal and forming an expansion space between the bead and an enclosing shoulder (27) on the outside of the measuring cup.

* * * * *